United States Patent [19]

Kito et al.

[11] Patent Number: 4,878,812

[45] Date of Patent: Nov. 7, 1989

[54] TURBINE ROTOR

[75] Inventors: Tomohisa Kito; Katsuhisa Yabuta; Yoshinori Hattori, all of Aichi, Japan

[73] Assignee: NGK Spark Plug, Co., Ltd., Aichi, Japan

[21] Appl. No.: 201,722

[22] Filed: Jun. 3, 1988

[30] Foreign Application Priority Data

Jun. 5, 1987 [JP] Japan ..... 62-141271

[51] Int. Cl.[4] ..... F01D 5/28

[52] U.S. Cl. ..... 416/241 B

[58] Field of Search ..... 416/241 B; 415/214

[56] References Cited

U.S. PATENT DOCUMENTS 3,905,723 9/1975 Torti, Jr. ..... 416/241 B 4,571,414 2/1986 Renlund et al. ..... 501/90 X 4,693,986 9/1987 Vit et al. ..... 501/1

4,696,777 9/1987 Ito ..... 416/241 B X

*Primary Examiner*—Edward K. Look

*Assistant Examiner*—Joseph M. Pitko

*Attorney, Agent, or Firm*—Sughrue, Mion, Zinn, Macpeak & Seas

[57] ABSTRACT

A turbine rotor having a ceramic turbine wheel having an improved resistance to cracking and breaking. The turbine wheel is made of a ceramic material having pores formed therein with a maximum diameter of 20 μm distributed in the blade portion of the wheel at a porosity of 2 to 10 vol. %. Preferably, the volume porosity of the pores is gradually decreased from the blade surface to the interior of the blade portions.

1 Claim, 2 Drawing Sheets

TURBINE ROTOR

BACKGROUND OF THE INVENTION

The present invention relates to turbine rotors suitable for use in turbocharges, gas turbines, and the like.

Recently, turbine wheels of turbine rotors have been made of ceramics in ordet to reduce the overall weight of the turbine rotor, as well as to improve the acceleration response of the turbine and to increase the resistance to high temperature gases. Since a turbine wheel rotates at a high speed in a high temperature environment, to attain a high reliability, high strength at elevated temperature and high fracture toughness, the material of the turbine wheel is generally sintered silicon nitride ceramics having substantially no pores.

However, ceramics have a lower fracture toughness than metals, and hence there is a tendency for a ceramic turbine wheel to break due to oxide scale material entering the turbine rotor from the exhaust manifold.

It is an object of the present invention to eliminate this problem.

SUMMARY OF THE INVENTION

In accordance with the above and other objects of the present invention, there is provided a turbine rotor having a ceramic turbine wheel made of a material having pores of a maximum diameter of 20 μm and a porosity of 2 to 10 vol. % distributed in a blade portion of the turbine wheel. Preferably, the volume porosity of the pores is gradually decreased from the blade surface to the inside of the blade.

DESCRIPTION OF THE PREFERRED EMBODIMENTS

As described above, in accordance with the invention, there is provided a turbine rotor having a ceramic turbine wheel made of a material having pores of a maximum diameter of 20 μm and a porosity of 2 to 10 vol. % distributed in a blade portion of the turbine wheel.

This distribution of pores reduces the Young's modulus and the hardness of the blade portion of the turbine wheel and thus makes the blade portion more easily elastically deformable. As a result, the impact energy acting on the blade portion when the blade collides with oxide scale material is absorbed by elastic deformation, preventing breakage of the blade. Furthermore, the present of pores prevents crack growth; that is, the apparent $K_{IC}$ is large.

Since the strength of a ceramic depends upon the maximum diameter of its pores, the maximum diameter was limited to 20 μm so that the strength of the material is not lowered to the point where it becomes useless. Further, if the porosity is lower than 2 vol. %, impact damage resistance does not increase, while if the porosity exceeds 10 vol. %, the heat resistance of the material is greatly reduced. Thus, the porosity was limited to the range of 2 to 10 vol. %

Methods which may be employed to suitably distribute the pores in the material include a method of separately molding the blade portion at a pressure lower than that employed to mold the hub portion and then sintering the blade portion so as to be integrated with the hub portion, a method of dispersing an organic material which can easily be burned up in the molding of the blade portion and then heating the molding, and a method of adding an oxide which can easily be dispersed in a nonoxidizing atmosphere to the molding which forms the blade portion and dispersing the oxide by means of a heat treatment.

Since the blade portion receives impact most strongly at a blade surface layer portion thereof and it is generally preferably to make the blade portion dense at the inside thereof and in the vicinity of the hub portion, the distribution of pores in the blade portion need not always be uniform, and the blade portion may have a structure in which the volume percentage of the pores decreases gradually from the blade surface to the inside.

EXAMPLE

Figure 1:
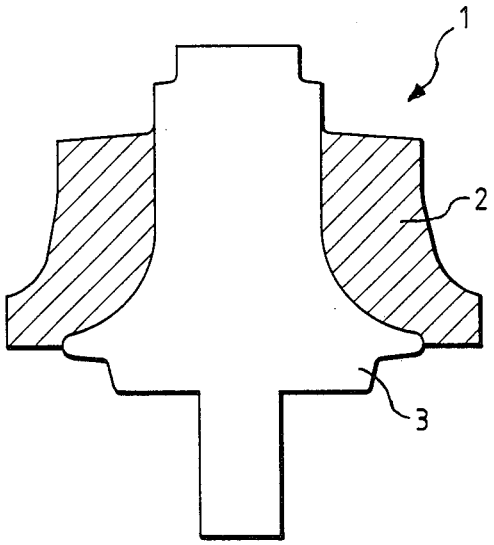
FIG. 1 is a sectional view of a turbine rotor taken in the axial direction thereof.

An organic molding binder was added to and mixed with a powder blend consisting of 95 wt. % of silicon nitride having a mean grain size of 0.5 μm and an α rate of 90%, 2 wt. % of aluminum oxide, 2 wt. % of yttrium oxide, and 1 wt. % of magnesium oxide. With this mixture, a blade portion 2 and a hub portion 3, as shown in FIG. 1, were integrally molded simultaneously using an injection molding process, and subjected to isostatic pressing at a pressure of 2,000 kg/cm$^2$ after dewaxing. The blade portion 2 and hub portion 3 were then sintered in a gas pressure sintering process at a pressure of 20 atm. at 1800° C. for two hours, and then at 75 atm. and 1850° C. for one hour, and then subjected to a heat treatment while the moldings were packed in a silicon nitride case and held at 5 atm. and 1900° C. for two hours, whereby a turbine rotor 1 according the invention was produced.

As a comparison, a turbine rotor having a density of 99% or more relative density was produced under the same conditions as the example of the invention, except that no heat treatment was performed.

The porosity of the turbine rotor of the invention was measured to be 4.3 vol. % and 1 vol. % for the comparative turbine rotor.

Figure 2:
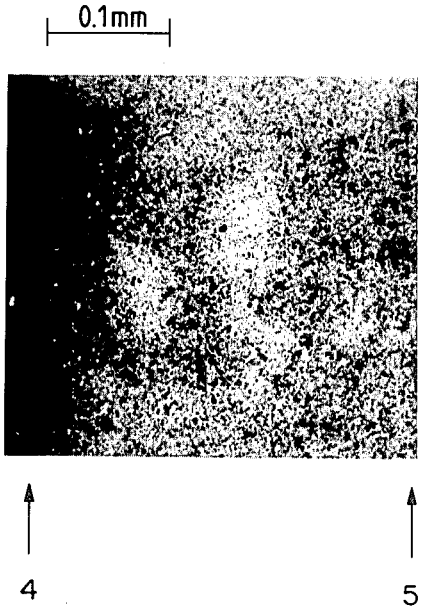
FIGS. 2 and 3 are electron microscopic photographs showing microstructures in sections of a turbine wheel in a turbine rotor constructed in accordance with the present invention.
Figure 3:
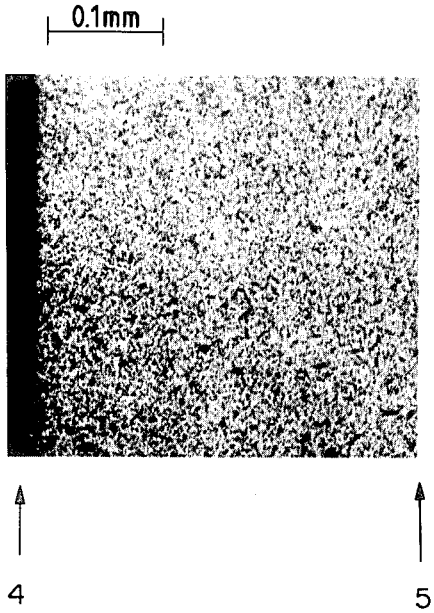

FIGS. 2 and 3 are, respectively, photographs taken with a scanning electron microscope of sections of the blade portions of the turbine rotor of the invention and the comparative example. Reference numeral 4 indicates the surface direction and reference numeral 5 indicates the inside direction. From these photographs it was confirmed that pores having a maximum diameter of 10 μm were distributed in the blade portion of the turbine of the invention, while there were scarcely any pores at all in the blade portion of the comparative example.

A metal shaft was connected to each of the two turbine rotors, and each turbine rotor was turned at a peripheral speed of 350 m/sec while a combustion gas at 950° C. was blown against the turbine rotors. Also, steel balls of various weights were injected into the combustion gas stream and made to collide against the blade portions of the two turbine rotors. The ball weight at which breaking or cracking began to occur was observed. For the case of the turbine rotor of the invention, the ball weight at which breaking or cracking began was 12 mg, while for the comparative example, the ball weight was 7 mg. Therefore, it was demonstrated that the impact damage resistance of the turbine rotor of the present invention is significantly better than in the conventional case.

What is claimed is:

1. In a turbine rotor having a ceramic turbine wheel, wherein the improvement comprises said ceramic turbine wheel being made of a material having pores having a maximum diameter of 20 μm distributed in a blade portion of said turbine wheel at a porosity of 2 to 10 vol. % and wherein the volume porosity of said pores gradually decreases from a blade surface of said blade portion to an inside thereof.

* * * * *